US011930843B2

(12) United States Patent
Tasselli et al.

(10) Patent No.: US 11,930,843 B2
(45) Date of Patent: Mar. 19, 2024

(54) CARTRIDGE FOR ELECTRONIC DELIVERY SYSTEM

(71) Applicant: McNeil AB, Helsingborg (SE)

(72) Inventors: Corrado Tasselli, Malmö (SE); Cheng-Hsien Lu, Taoyuan (TW); Chun-Hao Hsu, Taoyuan (TW)

(73) Assignee: McNeil AB, Helsingborg (SE)

( * ) Notice: Subject to any disclaimer, the term of this patent is extended or adjusted under 35 U.S.C. 154(b) by 885 days.

(21) Appl. No.: 16/967,048

(22) PCT Filed: Feb. 5, 2019

(86) PCT No.: PCT/EP2019/052787
§ 371 (c)(1),
(2) Date: Aug. 3, 2020

(87) PCT Pub. No.: WO2019/154811
PCT Pub. Date: Aug. 15, 2019

(65) Prior Publication Data

US 2021/0145053 A1 May 20, 2021

(30) Foreign Application Priority Data

Feb. 6, 2018 (SE) ..... 1850134-6

(51) Int. Cl.
*A24F 40/42* (2020.01)
*A24B 15/167* (2020.01)
(Continued)

(52) U.S. Cl.
CPC ..... *A24F 40/42* (2020.01); *A24B 15/167* (2016.11); *A24F 40/44* (2020.01); *A24F 40/485* (2020.01); *A24F 40/10* (2020.01)

(58) Field of Classification Search
CPC ..... A24F 40/42; A24F 40/485; A24F 40/44; A24F 40/10
(Continued)

(56) References Cited

U.S. PATENT DOCUMENTS 9,955,734 B2 * 5/2018 Lin ..... A24F 40/70
10,226,076 B2 * 3/2019 Althorpe ..... A24F 40/40
(Continued)

FOREIGN PATENT DOCUMENTS

CN 105795522 A 7/2016
EP 2810570 A 12/2014
(Continued)

OTHER PUBLICATIONS

SE Search Report and Examination Report dated Sep. 6, 2018, for SE 1850134-6.
(Continued)

*Primary Examiner* — Alexander Gilman

(57) ABSTRACT

A cartridge assembly may be utilized in combination with an electronic nicotine delivery system for the safe, efficient and cost-effective means for delivering a controlled dose of nicotine to a user on demand. The cartridge assembly includes a reservoir with a material for holding liquid nicotine or a liquid nicotine solution and is constructed from a material that is chemically resistant to nicotine or nicotine solution. The cartridge assembly includes an anti-counterfeit feature to prevent use of an unauthorized cartridge in the electronic nicotine delivery system. The cartridge assembly also includes an anti-reuse feature that precludes reuse of the cartridge assembly once removed from the electronic nicotine delivery system. Essentially, the cartridge assembly is designed for a single use only.

18 Claims, 11 Drawing Sheets

(51) Int. Cl.
*A24F 40/44* (2020.01)
*A24F 40/485* (2020.01)
*A24F 40/10* (2020.01)

(58) Field of Classification Search
USPC ..... 131/329
See application file for complete search history.

(56) References Cited

U.S. PATENT DOCUMENTS 10,531,692 B2 * 1/2020 Althorpe ..... A24F 40/42
10,542,781 B2 * 1/2020 Althorpe ..... A24F 40/44
10,701,976 B2 * 7/2020 Verleur ..... A61M 15/06
10,791,768 B2 * 10/2020 Althorpe ..... A24F 40/40
10,980,287 B2 * 4/2021 Mazur ..... A61M 15/0036
11,160,306 B2 * 11/2021 Daryani ..... A24F 40/42
11,525,029 B2 * 12/2022 Trumbo ..... C08J 9/12
2013/0160780 A1 6/2013 Matsumoto et al.
2014/0345635 A1 11/2014 Rabinowitz et al.
2014/0346689 A1 * 11/2014 Dubief ..... A24F 40/44 261/142
2015/0020830 A1 1/2015 Koller
2016/0000147 A1 * 1/2016 Li ..... A24F 40/485 392/404
2016/0029698 A1 * 2/2016 Xiang ..... A24F 40/65 131/328
2016/0120222 A1 * 5/2016 Bagai ..... A24F 40/42 206/242
2016/0135505 A1 * 5/2016 Li ..... H05B 3/44 131/329
2016/0143365 A1 * 5/2016 Liu ..... A61M 11/041 131/329
2016/0157523 A1 * 6/2016 Liu ..... A61M 15/0085 392/395
2016/0353802 A1 * 12/2016 Malgat ..... A24F 40/42
2017/0156398 A1 * 6/2017 Sur ..... H04N 1/212
2017/0172210 A1 6/2017 Bright et al.
2017/0208863 A1 * 7/2017 Davis ..... A61M 15/06
2017/0233114 A1 * 8/2017 Christensen ..... B65B 3/14 141/2
2017/0325506 A1 * 11/2017 Batista ..... A24F 40/42
2017/0360092 A1 * 12/2017 Althorpe ..... A61M 15/06
2017/0367407 A1 * 12/2017 Althorpe ..... A24F 40/40
2018/0029782 A1 * 2/2018 Zuber ..... H05B 1/0227
2018/0084828 A1 * 3/2018 Phillips ..... A24F 40/42
2020/0000143 A1 * 1/2020 Anderson ..... G06F 18/22
2020/0046029 A1 * 2/2020 Adair ..... A24F 40/485

FOREIGN PATENT DOCUMENTS

EP 3009017 A 4/2016
EP 3135139 A 3/2017
EP 3138425 A 3/2017
EP 3272236 A 1/2018
EP 2991515 B 5/2018
WO WO 2008/038199 A 4/2008
WO WO 2015/071703 A 5/2015
WO WO 2016/079151 A 5/2016
WO WO 2016/079152 A 5/2016
WO WO 2017/108992 A 6/2017
WO WO 2017/163045 A 9/2017

OTHER PUBLICATIONS

International Search Report and Opinion dated May 9, 2019 for PCT/EP2019/052787.

* cited by examiner

CARTRIDGE FOR ELECTRONIC DELIVERY SYSTEM

CROSS-REFERENCE TO RELATED APPLICATIONS

This application is the national stage filing under 35 USC 371 of international application PCT/EP2019/052787 filed on Feb. 5, 2019, which claims priority to SE 1850134-6 filed on Feb. 6, 2018.

FIELD OF INVENTION

The present invention relates to a single use, tamper resistant cartridge assembly for utilization in and part of an electronic delivery system for delivery of nicotine as an aerosol.

BACKGROUND OF INVENTION

Currently electronic delivery systems; namely, devices for the delivery of nicotine in a liquid form, have been developed and are widely utilized as an aide in smoking cessation. One example of such a device is disclosed in WO2016/0057155. Normally, such devices comprise a reusable or disposable cartridge in which the liquid is contained. The device disclosed in WO2016/0057155 comprises a housing and a disposable cartridge including a reservoir containing a nicotine solution. A nicotine aerosol is formed in a vaporization chamber. The cartridge also comprises a mouthpiece with an outlet for inhaling the nicotine aerosol from the device. WO 2016/079151 discloses a child-resistant container for cartridges containing a nicotine-containing solution includes. The child-resistant container a first chamber having an opening, a waste chamber having an opening, and an unused disposable cartridge containing a nicotine-containing liquid. The first chamber locks the unused disposable cartridge therein and is arranged and configured to release the unused disposable cartridge upon attachment of the disposable cartridge to a receptacle disposed in electronic nicotine delivery system housing. The waste chamber is arranged and configured to lock a used disposable cartridge therein and to release the used disposable cartridge from the receptacle disposed in electronic nicotine delivery system housing. US20170156398 discloses an aerosol delivery device, which includes a housing, a cartridge coupled to the housing, a control component contained within the housing, and a camera system including a digital camera on the housing. The control component is configured to control operation of the aerosol delivery device in response to detection of airflow through at least a portion of the housing or cartridge. The digital camera is configured to capture images of an object or scene in a field of view thereof, with the images being transferrable locally to a memory configured to store the images, or externally to a computing device configured to store or display the images.

Currently available marketed e-cigarettes may not adequately address the nicotine craving that a person intending to quit traditional cigarette experiences. Some of these e-cigarettes, for example, are made to look and feel like traditional cigarettes, which aspects may reinforce the ritual of smoking traditional cigarettes rather than undermine those rituals in ways that are helpful to smokers' efforts to quit smoking. While currently marketed e-cigarettes arguably pose fewer health risks than smoking combustible tobacco products, many smokers adopt e-cigarettes without fully relinquishing smoking traditional cigarettes. Known as "dual use", this practice is widespread and compromises the health benefits that e-cigarettes may offer. This dual use practice arises, in part, because most or all currently marketed e-cigarettes are not designed for smoking cessation. Users of the e-cigarettes typically under dose themselves when using the marketed e-cigarettes for smoking cessation purposes, leaving them in a chronic state of low-level nicotine withdrawal. Also, most or all currently marketed e-cigarettes are not designed to adequately prevent nicotine spills. Therefore, users of these e-cigarettes and anyone, including children, who may come into contact with these e-cigarettes are at risk of exposure to the nicotine solution contained therein.

Other issues with currently marketed e-cigarettes, include lack of control of the heating element, differences in nicotine delivery, including dosing, and risk of battery explosion.

Accordingly, there exists a need for an electronic nicotine delivery system ("ENDS") and associated cartridge that provides a safe and effective means of delivering nicotine in measured doses.

SUMMARY OF THE INVENTION

The single use, tamper resistant cartridge assembly for an electronic nicotine delivery system in accordance with the present invention overcomes the limitations associated with the prior art as briefly described above.

The single use, tamper resistant cartridge assembly may be configured to fit in an electronic nicotine delivery system. The cartridge assembly needs to be chemically resistant to the nicotine solution, not allowing any external components to enter into the cartridge assembly, and to function properly together with the other functional components when positioned within the nicotine delivery system. In addition, it is preferred that the cartridge assembly cannot be reused and thus ensure that there is no harm to any human due to use of a reused cartridge with a non-original and non-approved nicotine solution.

The present invention is directed, at least in part, to a cartridge assembly for use in an electronic nicotine delivery system. In one exemplary embodiment, the cartridge assembly includes a body defining a reservoir and comprising a sealing element/cap disposed at a first or bottom end of the cartridge body and a mouthpiece disposed at second or top end of the cartridge body opposite the first or top end. In an exemplary embodiment, the sealing element/cap includes an opening configured to allow insertion of at least a portion of a wick into the reservoir. The cartridge assembly also includes an anti-reuse feature disposed on the body of the cartridge. The cartridge assembly further includes an anti-counterfeit tag positioned on the body of the cartridge assembly. In the exemplary embodiment, the reservoir is in a fluid communication with the mouthpiece for delivery of the aerosolized nicotine to the user. It is important to note that flavoring the nicotine may not be preferable until the nicotine addiction is overcome to avoid entice the user to smoke.

The cartridge assembly is one component of an electronic nicotine delivery system which comprises a housing for securing the cartridge assembly therein, a heating element for aerosolizing liquid nicotine from the reservoir within the cartridge assembly, a wick or other suitable element for conducting nicotine in the reservoir to the heating element, a power supply for providing energy to the heating element and for control, display, and operation elements of the electronic nicotine delivery system. The reservoir includes a fibrous mater, for example, a sponge or a wadding material, to serve as holder of the liquid nicotine solution present in the reservoir.

The electronic nicotine delivery system also comprises a mouthpiece operatively associated with the cartridge to allow user inhalation of a controlled dose of nicotine aerosol.

The cartridge assembly according to the present invention is constructed from a material that is chemically resistant to nicotine or nicotine solution. The cartridge assembly includes an authentication (an anti-counterfeit) feature to prevent use of an unauthorized cartridge assembly in the electronic nicotine delivery system of the present invention. In one exemplary embodiment, the authentication feature provides for detection of a counterfeit cartridge. In another exemplary embodiment, the cartridge assembly includes an anti-reuse feature that precludes reuse of the cartridge assembly once removed from the electronic nicotine delivery system. In other words, the cartridge assembly is designed for a single use only. More specifically, while multiple doses are available from a single cartridge, the cartridge assembly cannot be refilled and reutilized.

The cartridge assembly of the present invention is leakproof and safe to utilize. The cartridge assembly of the present invention provides a safe, efficient, and cost-effective means for delivering a controlled dose of nicotine to a user on demand.

In accordance with a first aspect, the present invention is directed to a cartridge assembly (2) for use in an electronic nicotine delivery system (4). In one embodiment, the cartridge assembly (2) comprises a body assembly (4) having an interior surface defining an interior volume. In one embodiment, the interior volume of the body assembly (6) includes a reservoir (8), the reservoir (8) having a top wall (10) with an opening (12) formed therein, a bottom wall/sealing element (14), and side walls (16) having an inner surface and an outer surface, the inner surface of the side walls (16) defining an interior volume (18) of the reservoir (8). In one embodiment, the interior volume (18) of the reservoir (8) secures a nicotine saturated fibrous material (20). In an alternative embodiment, the interior volume (18) of the reservoir (8) is configured for storing nicotine or nicotine solution.

In one embodiment, cartridge assembly (2) includes a port (22) formed in the bottom wall/sealing element (14) of the reservoir (8) to allow insertion of a wick (24) from the electronic nicotine delivery system (4). In one embodiment, cartridge assembly (2) further includes at least one conduit (26) formed between the outer surface of sidewalls (16) of the reservoir (8) and the interior surface of the body assembly (6), the at least one conduit (26) having at least one open top end (28) proximate the top wall (10) of the reservoir (8) and at least one open bottom end (30) proximate the bottom wall/sealing element (14) of the reservoir (8). In one embodiment, the at least one conduit (26) is configured for holding and distributing aerosolized nicotine.

In one embodiment, cartridge assembly (2) further includes a semipermeable membrane (32) positioned on the opening (12) in the top wall (10) of reservoir (8), the semi-permeable membrane (32) being configured to allow equalization of pressure between reservoir (8) and external environment during use. In one embodiment, the semipermeable membrane (32) comprises a microporous membrane that is gas permeable, to allow air to flow into and/or out of the reservoir (8), but liquid impermeable to prevent flow of a liquid into or out of the reservoir through the opening (12) in top wall (10) of the reservoir (8).

In one embodiment, cartridge assembly (2) further includes a manifold (34) positioned above the top wall (10) of the reservoir (8), the manifold (34) configured for holding and distributing aerosolized nicotine. In one embodiment, the manifold (34) includes an open top end (36), at least one open bottom end (38), and at least one interior channel (40) connecting the open top end (36) to the at least one open bottom end (38), wherein the at least one open bottom end (38) of the manifold (34) being secured onto the at least one open top end (28) of the at least one conduit (26) of the cartridge assembly (2) so as to form a continuous path from the open top end (36) to the at least one open bottom end (30) of the at least one conduit (26).

In one embodiment, cartridge assembly (2) further includes a mouthpiece (42) positioned above the manifold (34), the mouthpiece (42) having an outlet (44) in fluid communication with the at least one interior channel (40) of the manifold (34), the mouthpiece (42) being configured for delivering aerosolized nicotine into the mouth of a user.

In one embodiment, cartridge assembly (2) further includes at least one of an anti-counterfeit element (48) or an anti-reuse element (46) mounted to the outer surface of the body assembly (6). In one embodiment, the anti-counterfeit element (48) is configured to preclude use of unauthorized cartridge in the electronic nicotine delivery system (4). In one embodiment, the anti-reuse element (46) is configured to preclude reuse of the cartridge assembly (2) once removed from the electronic nicotine delivery system (4).

In accordance with a another aspect the invention relates to a single use, tamper resistant cartridge assembly for use in an electronic nicotine delivery system comprising a body assembly, a reservoir for a nicotine fluid, a sealing element/cap arranged at a first/bottom end of body assembly, the sealing element/cap comprising a valve and gasket configured as a seal for sealing the reservoir and configured with a wick opening, and a fibrous material, for example a sponge, arranged in the reservoir and extending to the first end of body assembly, wherein the sealing element/cap is configured to receive the wick, which extends through a wick opening and penetrates the valve to engage the fibrous material/sponge. In one embodiment, the cartridge assembly further includes a mouthpiece connector/manifold configured with two mouth piece channels, each mouth piece channel being connected to one of two separate air let channels of elongated passage, wherein the two mouth piece channels merge into an outlet of the mouth piece.

In accordance with yet another aspect the invention relates to a kit comprising at least one cartridge assembly as defined above.

In accordance with a final aspect the present invention relates to an electronic nicotine delivery device comprising the cartridge assembly as defined above.

BRIEF DESCRIPTION OF THE DRAWINGS

The foregoing and other features and advantages of the invention will be apparent from the following, more particular description of preferred embodiments of the invention, as illustrated in the accompanying drawings.

DETAILED DESCRIPTION OF EMBODIMENTS OF THE INVENTION

Figure 1:
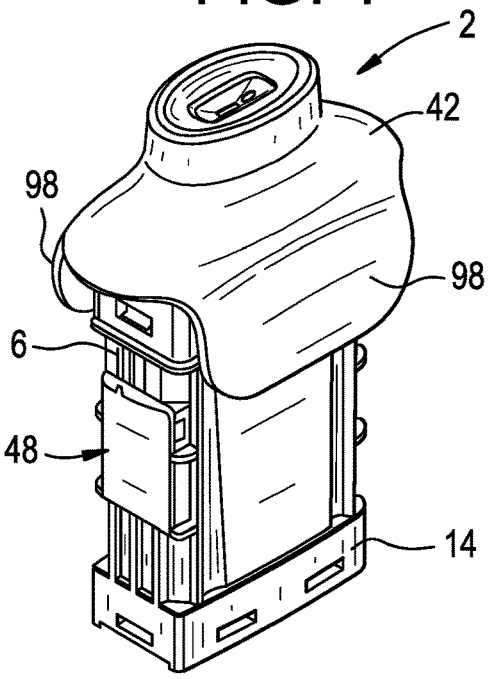
FIG. 1 is a schematic perspective view of a first exemplary embodiment of a cartridge assembly in accordance with the present invention comprising a first embodiment of a sealing element/cap.
Figure 2:
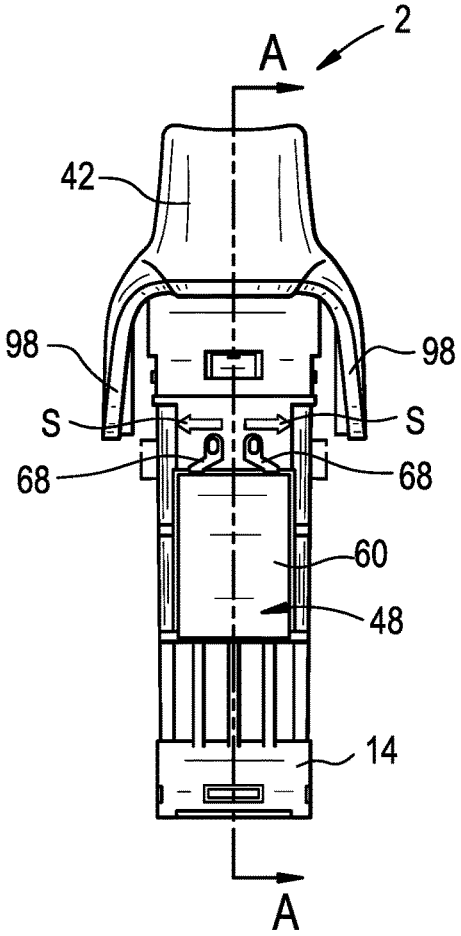
FIG. 2 is a schematic side view of the cartridge assembly of FIG. 1.
Figure 3A:
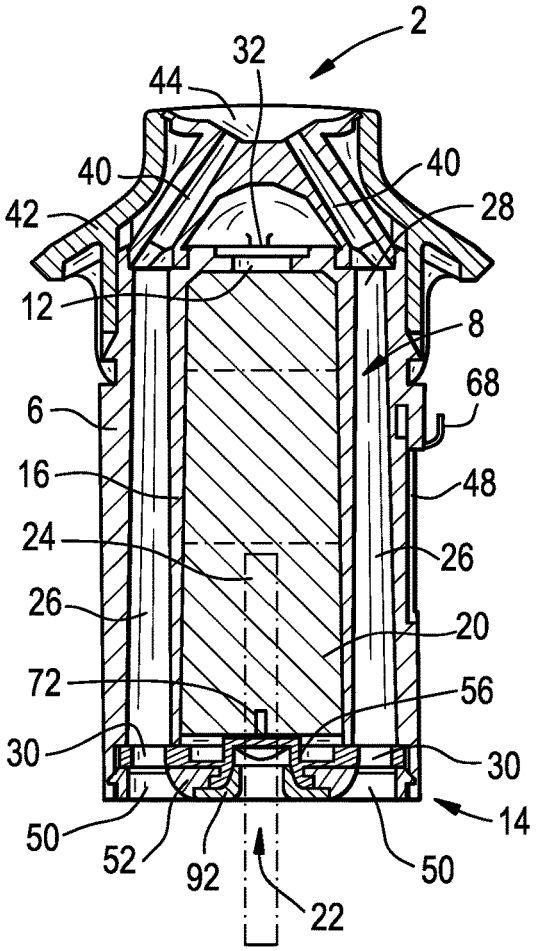
FIG. 3*a* is a cross-section along line A-A in FIG. 2 of the cartridge assembly of FIG. 1.
Figure 3B:
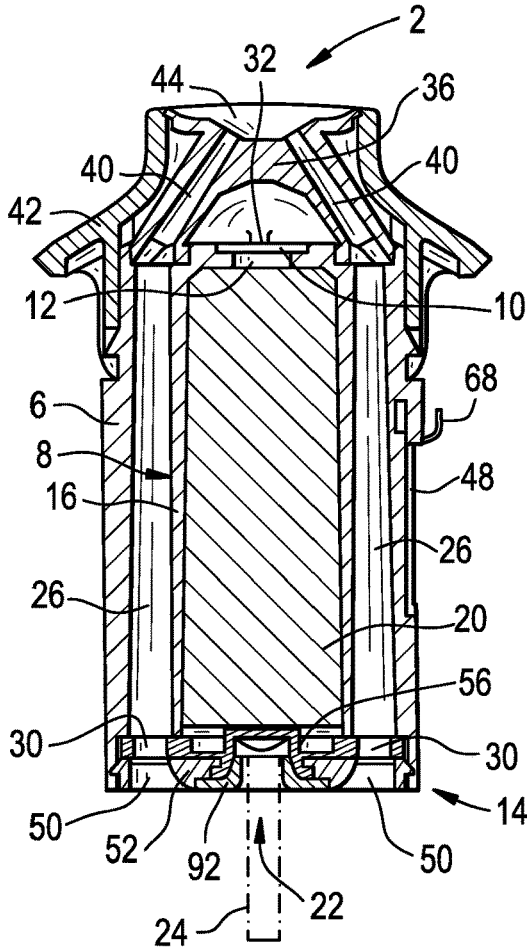
FIG. 3*b* is a cross-section from line A-A in FIG. 2 of an alternative exemplary embodiment of the cartridge assembly of FIG. 1.
Figure 4:
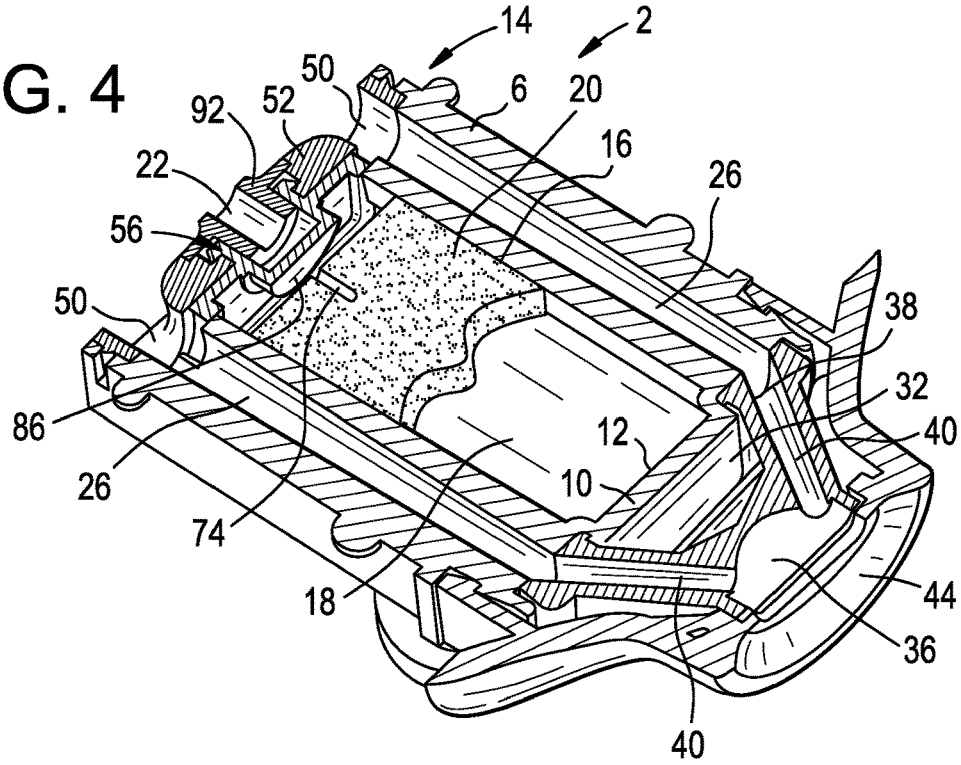
FIG. 4 a cross-section of an alternative exemplary embodiment of a cartridge with a second embodiment of a sealing element/cap in accordance with the present invention.

A more particular description of the invention, briefly summarized above may be had by reference to the exemplary embodiments thereof that are illustrated in the appended drawings. It is to be so noted; however, that the appended drawings illustrate only exemplary embodiments of the invention and, therefore, are not to be considered limiting of its scope, for the invention may admit to other equally effective embodiments.

Cartridge

In accordance with the present invention, as illustrated in FIGS. 1-15, a cartridge assembly (2) for an electronic nicotine delivery system (4) is disclosed. The cartridge assembly (2) comprises a body assembly (6) with an elongated reservoir (8) configured to hold a liquid, for example, a nicotine solution. In one exemplary embodiment, a sealing element/cap (14) comprising a valve (56) and a gasket (52) is arranged at a first/bottom end of the body assembly (6). In yet another exemplary embodiment, a sealing element/cap (14) comprising a hole/a port (22) with a valve is arranged at the first/bottom end of the body assembly (6). In yet another exemplary embodiment, the sealing element/cap (14) includes a hole/a port (22) with an integrated valve (56). In yet another exemplary embodiment, the sealing element/cap includes a hole/port 22 with a plug (90) described in greater detail below with respect to FIG. 13, which is removably retained in the port or wick opening (22) prior to use and is removed from the port (22) during use. The body assembly (6) also comprises openings or indents (114) that mate with elements (54) to secure the sealing element/cap (14) to the body assembly (6).

The cartridge assembly (2) is preferably made of a medical grade, chemical resistant to nicotine, polyamide (absorbs nicotine). In an alternative exemplary embodiment, the cartridge assembly (2) may be made from any suitable nicotine resistant polymeric material or metallic material, including stainless steel. The valve (56) forms a seal at an opening/port 22 of the reservoir (8). A guide element (92) is arranged exterior to the valve (56) and comprises a wick opening or port (22) for receiving an elongated wick (24) or any other suitable element. The wick (24) is preferably chemically resistant to nicotine, is temperature resistant, and preferably rigid to prevent collapse during insertion into the reservoir (8) or during use. A more detailed description of the wick (24) is given below. A fibrous material or sponge (20) or any liquid holding element is arranged in the reservoir (8) and extends to a position close to the first/bottom end of reservoir (8). When the wick (24) has penetrated the valve (56) and is received in the cartridge assembly (2) the fibrous material/sponge (20) will engage the wick (24) so as to allow fluid present in the reservoir (8) to be transported through the wick (24) to the heater (80) within the housing (66) of the electronic nicotine delivery system (4).

The cartridge assembly (2) as set forth herein is arranged for use in an electronic nicotine delivery system (4). In various exemplary embodiments, the sealing element/cap (14) comprises a valve (56), a guide element (92) and a gasket (52). The guide element (92) is configured with a wick opening (22) and will guide the wick (24) into a bottom end of the reservoir (8) through the valve (56). The valve (56) will seal the reservoir (8) when the wick (24) has penetrated the valve (56) and is received in the reservoir (8). The gasket (52) seals a bottom part of the cartridge assembly (2) and various openings and channels extend through the sealing element/cap (14).

The sealing element/cap (14) is attached to the body assembly (6) and forms a bottom section of the cartridge assembly (2). The body assembly (6) comprises at least one air-let channel/conduit (26) extending through at least one opening (50) in the gasket (52) to a mouth piece (42) at a second/top end of the body assembly (6). In various exemplary embodiments, two air-let channels/conduits (26) extend within the body assembly (6) exterior to and along the reservoir (8). The two air-let channels/conduits (26) open into two air-let/side openings (50) in the sealing element/cap (14). In various exemplary embodiments, a membrane (32) seals a top end/wall (10) of the reservoir (8) at the mouth piece (42). In various exemplary embodiments, the membrane (32) may be absent.

As set forth above, a single use, tamper resistant cartridge assembly (2) is utilized as an integral component in an electronic nicotine delivery system (4) for in smoking cessation. Referring, in greater detail, to FIGS. 1-15, there is illustrated a cartridge assembly (2) in accordance with the present invention. In one exemplary embodiment, the cartridge assembly (2) comprises a body assembly (6) having an interior surface defining an interior volume. The interior volume of the body assembly (6) includes a reservoir (8), the reservoir (8) having top wall (10) with an opening (12) formed therein, a bottom wall or sealing element (14), and side walls (16) having an inner surface and an outer surface, the inner surface of the side walls (16) defining an interior volume (18) of the reservoir (8). The interior volume (18) of the reservoir (8) secures a nicotine saturated fibrous material (20) therein.

The cartridge assembly (2) also includes a port (22) formed in the bottom wall or sealing element (14) of the reservoir (8) to allow insertion of a wick (24) or other suitable component from the electronic nicotine delivery system (4). The cartridge assembly (2) further includes at least one conduit (26) formed between the outer surface of sidewalls (16) of the reservoir (8) and the interior surface of the body assembly (6), the at least one conduit (26) having an open top end (28) proximate the top wall (10) of the reservoir (8) and an open bottom end (30) proximate the bottom wall or sealing element (14) of the reservoir (8). In the illustrated exemplary embodiment, there are two identical conduits (26). The at least one conduit (26) is configured for holding and distributing aerosolized nicotine as is explained in much greater detail subsequently.

The cartridge assembly (2) still further includes a semi-permeable membrane (32) positioned on the opening (12) in the top wall (10) of the reservoir (8), the semi-permeable membrane (32) being configured to allow equalization of the pressure between the reservoir (8) and the external environment during use. In one exemplary embodiment, the semi-permeable membrane (32) comprises a microporous membrane that is gas permeable, to allow air to flow into and/or out of the reservoir (8), but liquid impermeable to prevent flow of a liquid into or out of the reservoir (8) through the opening (12) in top wall (10) of the reservoir (8). The semi-permeable membrane (32) may be formed from any suitable material as explained in greater detail subsequently.

The cartridge assembly (2) still further includes a manifold (34) positioned above the top wall (10) of the reservoir (8), the manifold (34) is configured for holding and distributing aerosolized nicotine. In one exemplary embodiment, the manifold (34) includes an open top end (36), an open bottom end (38), and at least one interior channel (40) connecting the open top end (36) to the open bottom end (38), wherein the open bottom end (38) of the manifold (34) being secured onto the open top end (28) of the at least one conduit (26) of the cartridge assembly (2) so as to form a continuous path from the open top end (36) to the open bottom end (30) of the at least one conduit (26) for communicating the aerosolized nicotine.

The cartridge assembly (2) still further includes a mouthpiece (42) positioned above the manifold (34), the mouthpiece (42) having an outlet (44) in fluid communication with the at least one interior channel (40) of the manifold (34). The mouthpiece (42) being configured for delivering aerosolized nicotine into the mouth of a user. The mouthpiece (42) may be secured to the body assembly (6) via any suitable means, including tab (116) as illustrated in detail in FIG. 13.

The cartridge assembly (2) further includes at least one of an anti-counterfeit element (48) and/or an anti-reuse element (46) mounted to the outer surface of the body assembly (6). The anti-counterfeit element (48) is configured to preclude use of an unauthorized cartridge (2) in the electronic nicotine delivery system (4) while the anti-reuse element (46) is configured to preclude reuse of the cartridge assembly (2) once removed from the electronic nicotine delivery system (4).

Figure 13:
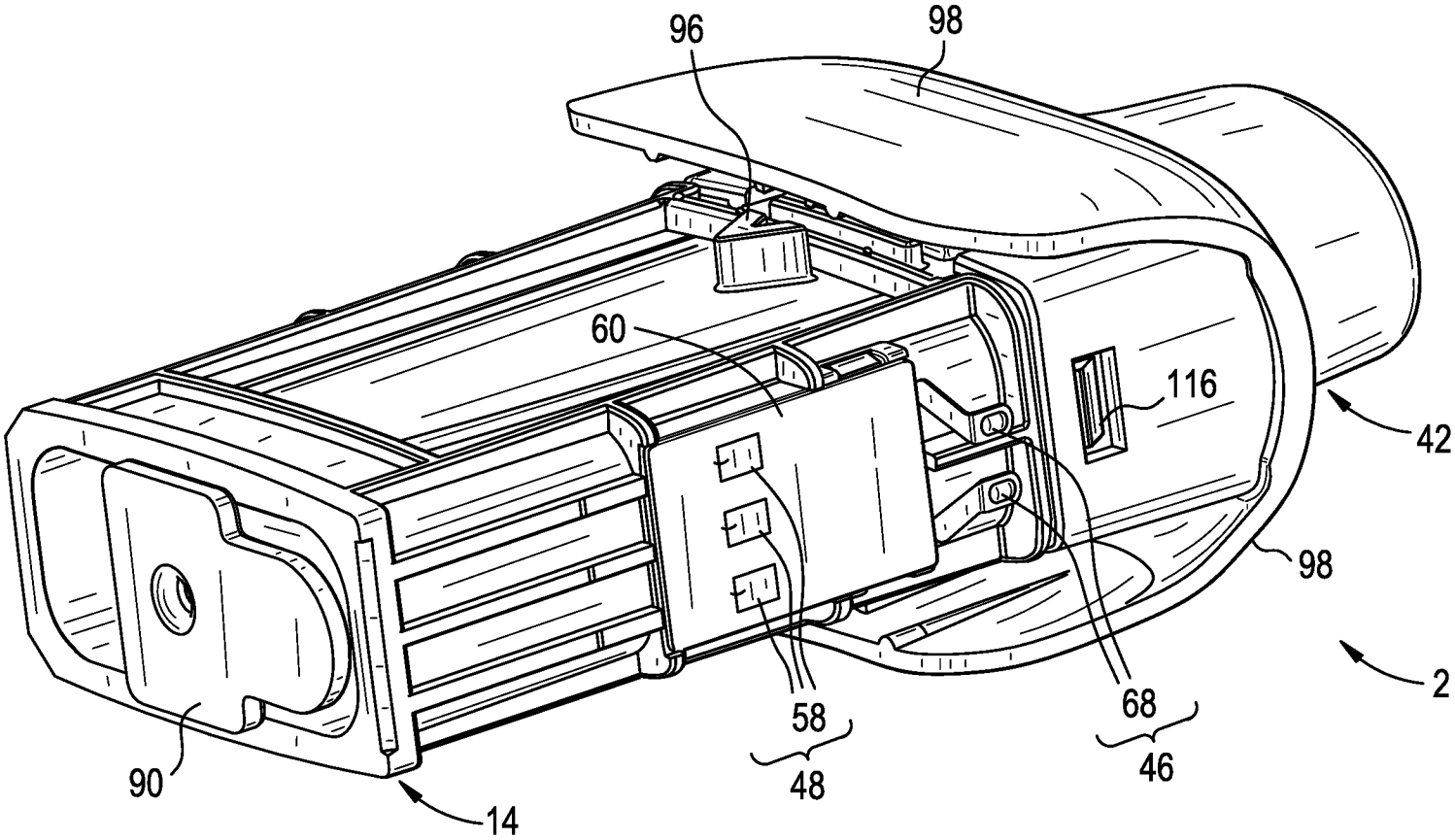
FIG. 13 is a side perspective view of the cartridge assembly in accordance with the present invention.
Figure 15:
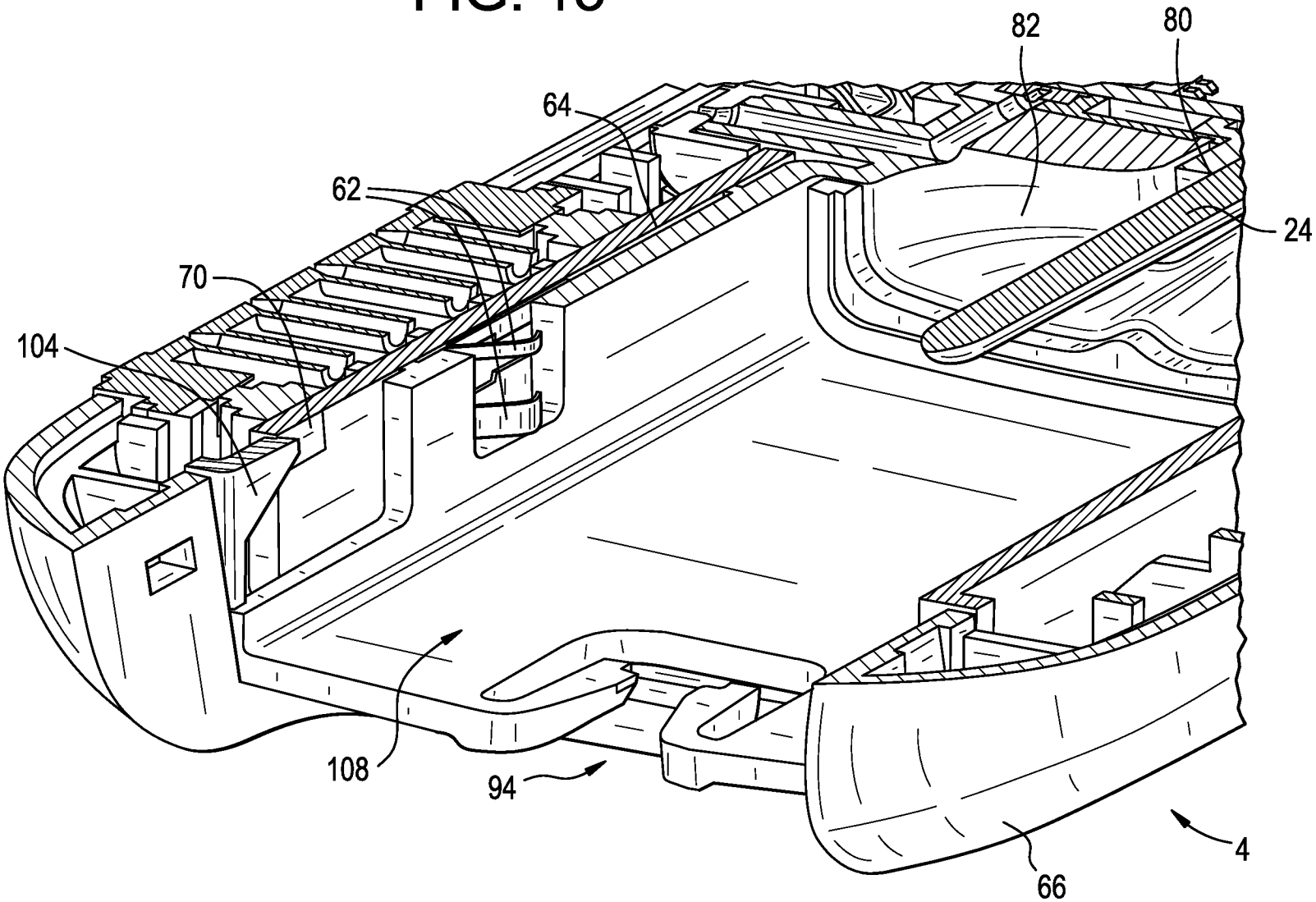
FIG. 15 is a partial cutaway perspective view of the electronic nicotine delivery system of the present invention of FIG. 12.

Referring specifically to FIG. 15, there is illustrated a female mating component (94) in housing (66) of electronic nicotine delivery system (4) that interlocks with male component (96), illustrated in FIG. 13, on an outer surface of the body assembly (6) of the cartridge assembly (2). These female/male components may comprise any suitable shape or any suitable mechanisms for locking the cartridge assembly (2) to the electronic nicotine delivery system (4).

Figure 8:
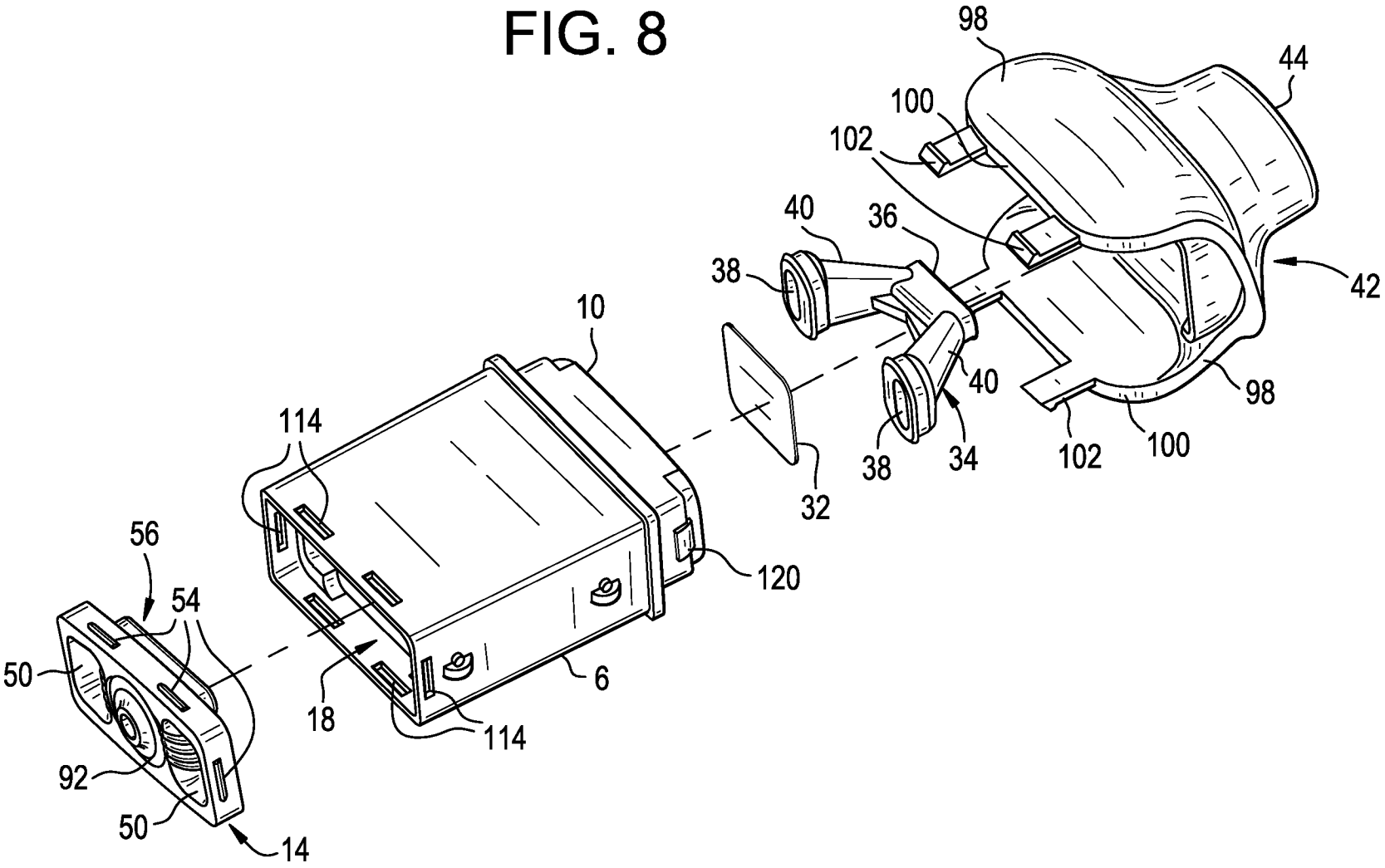
FIG. 8 is a first exploded diagrammatic view of an alternative embodiment of the cartridge assembly in accordance with the present invention.
Figure 9:
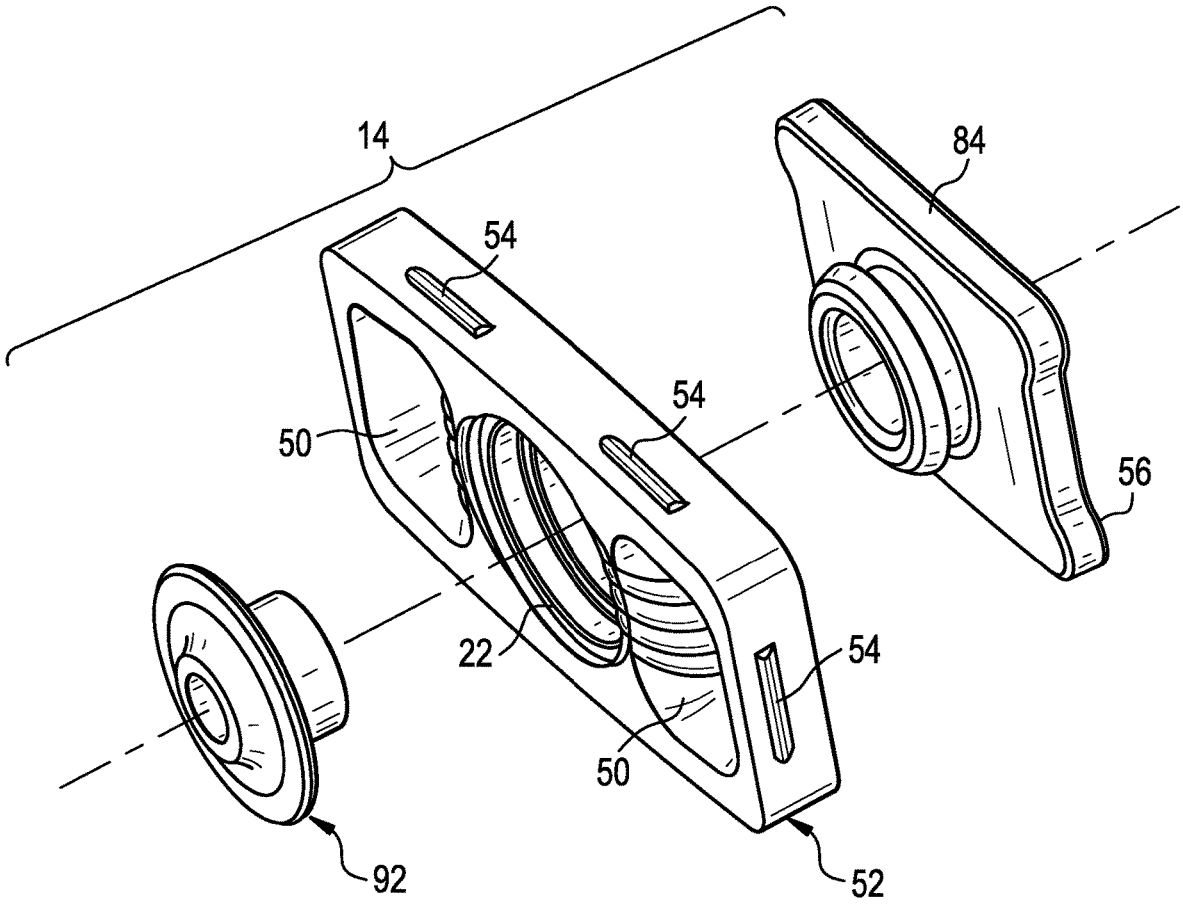
FIG. 9 is an exploded diagrammatic view of the sealing element of the cartridge assembly of FIG. 8.
Figure 10:
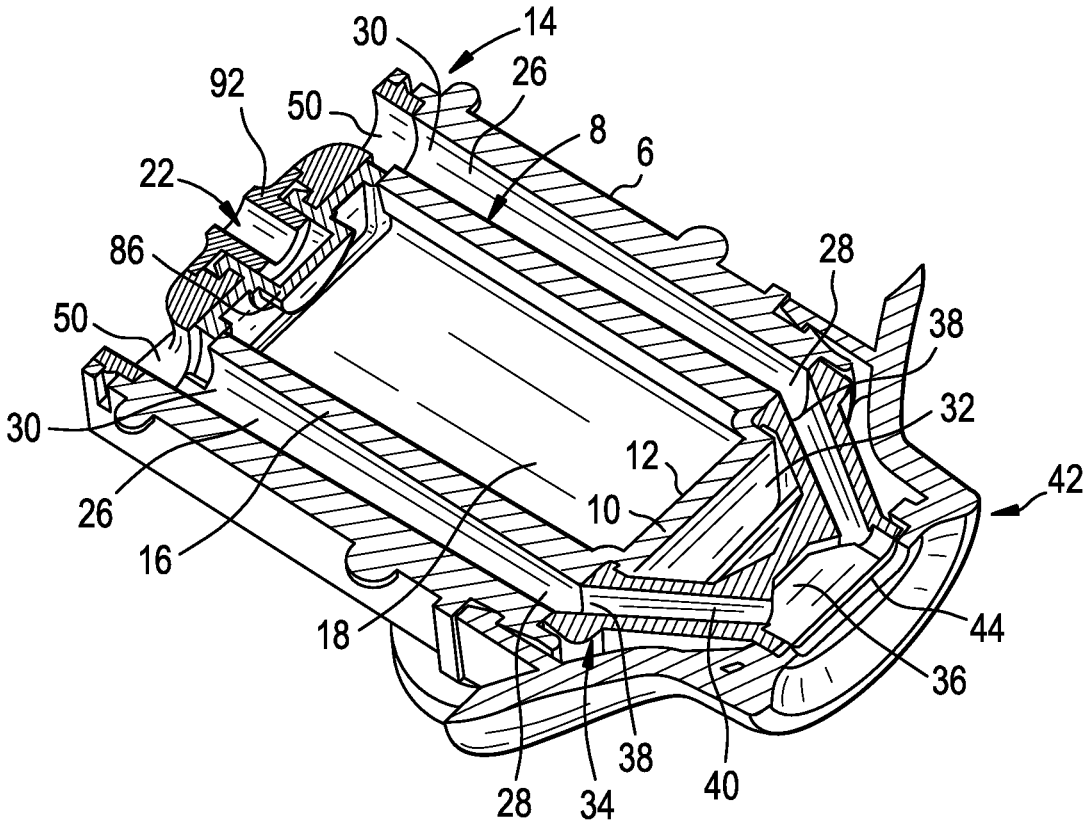
FIG. 10 is a sectional view of the cartridge assembly of FIG. 8.
Figure 11:
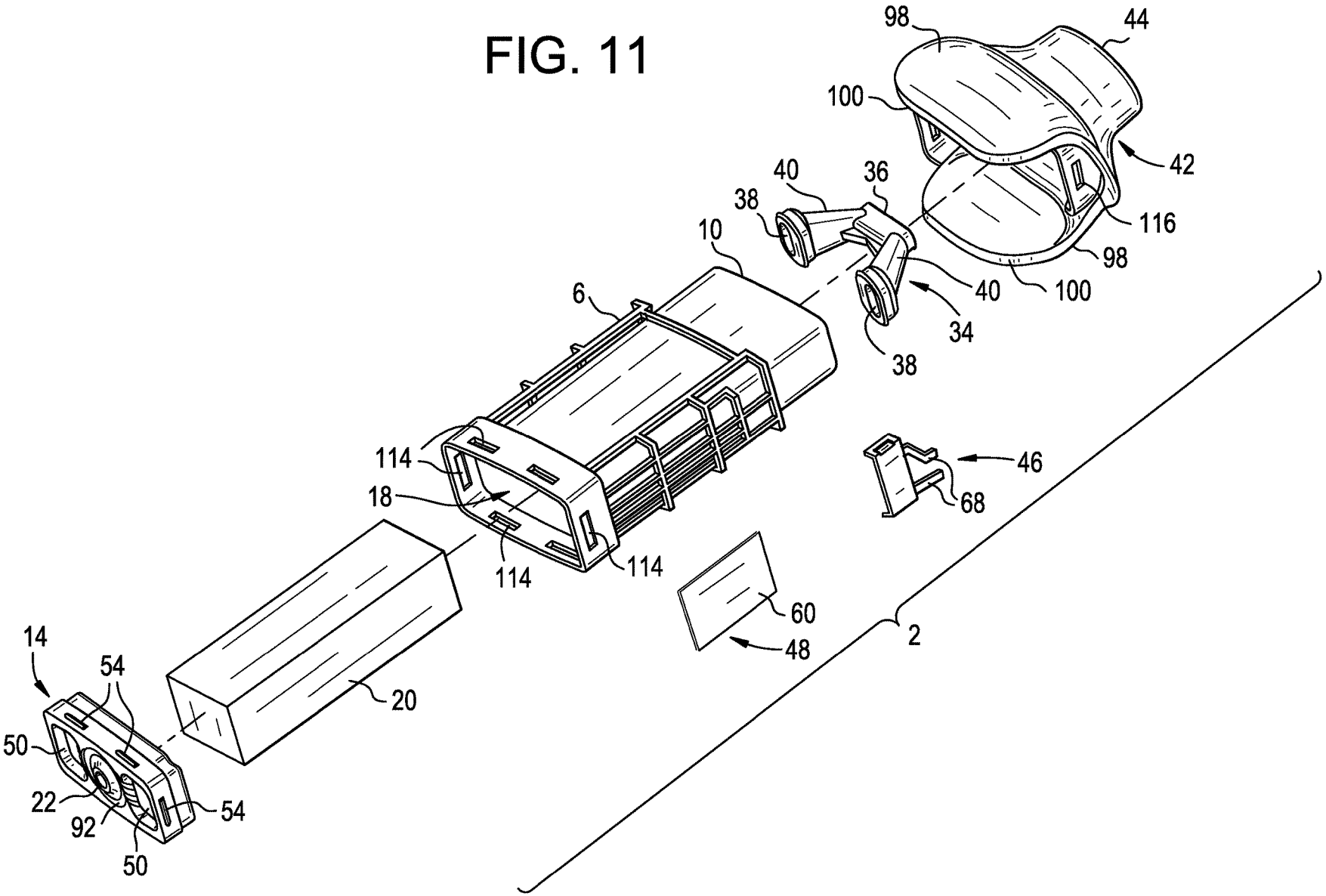
FIG. 11 is a second exploded diagrammatic view of an alternative embodiment of the cartridge assembly in accordance with the present invention.
Figure 12:
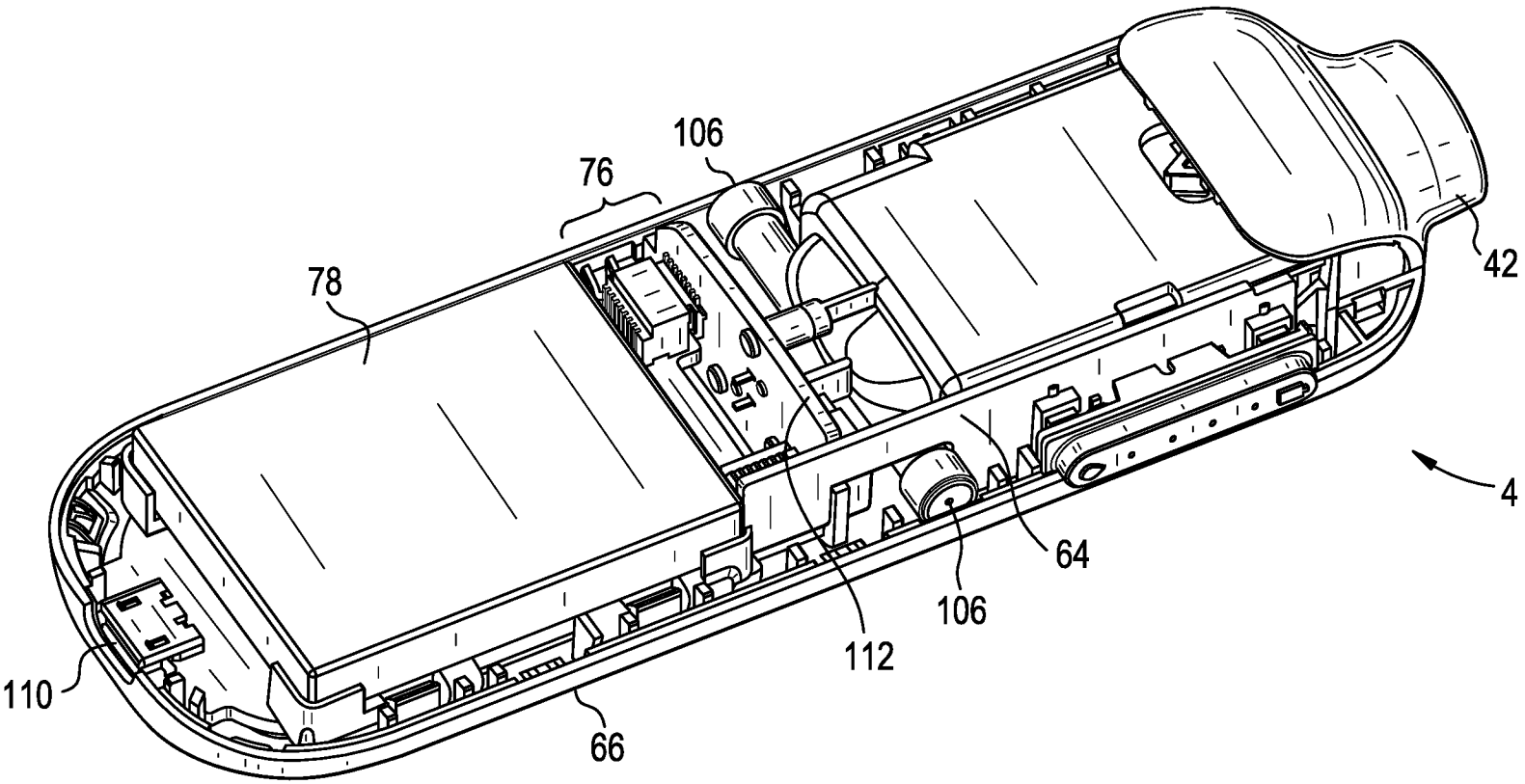
FIG. 12 is a diagrammatic representation of the electronic nicotine delivery system in accordance with the present invention.

Referring specifically to FIG. 8, there is illustrated an alternative exemplary embodiment of the locking mechanism for removably locking cartridge assembly (2) to housing (66) of the electronic nicotine delivery system (4). As shown in FIG. 8, mouthpiece assembly (42) includes a pair of flaps (98) extending downwardly at the front and back sides of mouthpiece assembly (42), each flap (98) having a peripheral edge (100). A plurality of interference fit tabs (102) extend from the peripheral edges (100) of the pair of flaps (98) and are configured to interlock with a matching plurality of indentions/slits (not shown) in housing (66) of the electronic nicotine delivery system (4) to secure the cartridge assembly (2) to the housing (66). The body assembly (6) also comprises an interference tab (120) or other suitable structure configured to mate with a corresponding structure; namely, an indent or slit 116 (FIG. 13) in the mouthpiece (42) to secure the mouthpiece (42) to the body assembly (6).

Referring back to FIG. 13, there is illustrated a plug (90) which covers the port (22) formed in the sealing element (14) of the reservoir (8). The plug (90) may be formed from any suitable material that is resistant to nicotine/nicotine solution. The plug (90) is configured to prevent accidental leakage of the nicotine/nicotine solution contained in the reservoir (8).

As set forth above, more particular descriptions of the cartridge assembly (2) and the electronic nicotine delivery system (4) is given below as well as a description of the nicotine formulations and operation of the device.

FIGS. 1-15 provide a more detailed illustration of the cartridge assembly (2) of the present invention. Referring now to FIGS. 1-15, the cartridge assembly (2) comprises at a first/bottom end or a sealing element/cap (14) and at a second/top end opposite to the first/bottom end a mouth piece (42). A reservoir (8) is provided in a body assembly (6) between the first end and the second end. In various exemplary embodiments, the body assembly (6) is elongated and comprises an elongated passage extending from first end of body assembly (6) to second end of body assembly (6). The reservoir (8) is arranged at a central position between two air-let channels (26) forming the elongated passage. The two air-let channels (26) extend along opposite sides of the reservoir (8) from air-let openings (50) in the sealing element/cap (14) to two mouth piece channels (40) in a mouth piece connector/manifold (34) of the mouth piece (42). The mouthpiece (42) promotes a favorable tactile response for the user. The cartridge assembly (2) is reusable for a period of time after which it is replaced when a new cartridge is installed. In a preferred embodiment, the mouthpiece (42) is formed from and is integral with the cartridge assembly (2).

Side openings (50) in sealing element (14) extend through the body of valve (56) to the air-let channels (26). The two mouth piece channels (40) merge into an outlet (44) in the mouthpiece (42), forming an inhalation opening of the mouthpiece (42) where a user inhales the nicotine vapor. The two mouthpiece channels (40) allow air to pass in or out, such as vapor from the solution present in the reservoir, for example, a nicotine solution. In one exemplary embodiment, the reservoir (8) is centered, in which case two channels (40) are preferred. In an alternative exemplary embodiment, the reservoir (8) may be shifted to the left or right of the longitudinal axis of the electronic nicotine delivery system (4), in which case a single channel (40) may be used. It is important to note that the two channels (40) may better mix the nicotine aerosol traveling therethrough.

In various exemplary embodiments, the sealing element/cap (14) comprises three main parts, a valve (56), a gasket (52), and a guide element (92). In one embodiment, the valve (56) and the gasket (52) extend over substantially a full bottom portion of cartridge assembly (2). In one exemplary embodiment, the guide element (92) is arranged in a central exterior position of gasket (52) and configured to guide the wick (24) on an inclining inner envelope surface into the interior of cartridge assembly (2). In one exemplary embodiment, the wick (24) extends into the reservoir (8) when the cartridge assembly (2) is inserted into the electronic nicotine delivery system (4) to facilitate transfer of nicotine from the reservoir (8) to the heater (80) within the housing (66) of the electronic nicotine delivery system (4). In one exemplary embodiment, the sealing element (14) includes a valve (56) arranged as a seal at a bottom end of reservoir (8). When the wick (24) is inserted through guide element (92) it will penetrate valve (56) and extend into interior volume (18) of reservoir (8) to contact a nicotine solution contained in the reservoir. In one exemplary embodiment, a nicotine saturated fibrous material (20) is disposed within interior volume (18) of reservoir (8) and the wick (24) is configured to contact the nicotine saturated fibrous material (20) in order to transfer nicotine from the fibrous material (20) to the heater (80) within the housing (66). In one exemplary embodiment, the fibrous material (20) is made of a porous material such as polyethylene terephthalate (PET) or polybutylene terephthalate (PBT) or a mixture thereof. It is important to note that any suitable material may be utilized.

The wick (24) may be made from any suitable material that is resistant to nicotine, has suitable temperature resistance, for example, polyethylene terephthalate or PET, and is preferably rigid. It is important to note that the wick (24) of the present invention should preferably not be made from cotton because such wick would collapse onto itself because it is not sufficiently rigid to withstand repeated insertion into and removal from the port (22) of the cartridge assembly (2).

In various exemplary embodiments, the anti-reuse element (46) includes a plurality of springs 68, which are configured to be disrupted, changed, or damaged upon removal of the cartridge assembly (2) from the electronic nicotine delivery system (4). By introducing such anti-reuse feature, i.e. the spring being destroyed during withdrawal of cartridge assembly (2) from the housing (66) of the electronic nicotine delivery system (4), the risk of the cartridge assembly (2) being reused is minimized. Minimizing the risk of cartridge assembly (2) reuse, prevents refilled or otherwise altered cartridges to be used with the electronic nicotine delivery system (4).

In various exemplary embodiments, the fibrous material (20) is formed as a one piece substantially filling out the full interior volume (18) of reservoir (8). As a first alternative, the size of the fibrous material (20) is smaller than the full interior volume (18) of reservoir (8), and as a second alternative, the fibrous material (20) comprises two or more separate fibrous elements as indicated with dash and dotted lines in FIG. 3*a*. The fibrous material (20) may be provided with a slit (72) that may expand into a cavity (74), or an indication of fracture in a position where the wick (24) will enter the reservoir (8), so as to facilitate the penetration of wick (24) into the fibrous material (20). When the wick (24) engages or penetrates the fibrous material (20) it will start transporting the solution present within the reservoir (8) out of the reservoir (8). In various exemplary embodiments, the wick (24) will be soaked or saturated with a solution, such as a nicotine solution. In various exemplary embodiments the fibrous material (20) comprises two fibrous material units.

Figure 7:
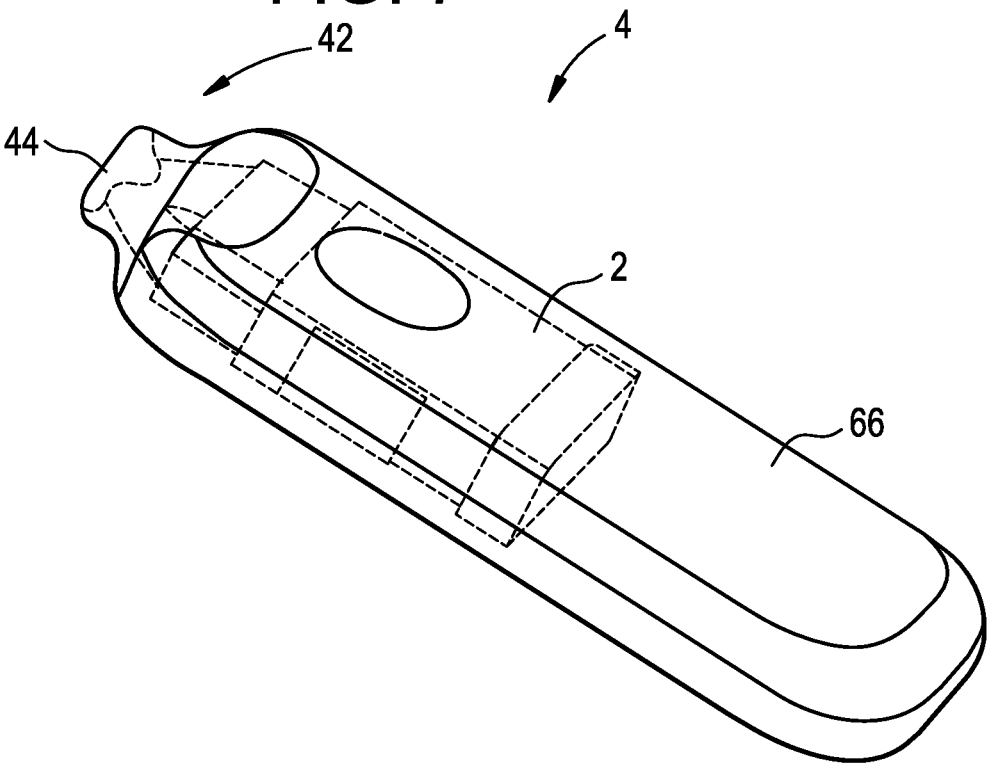
FIG. 7 is a schematic perspective view of an electronic nicotine delivery device for the delivery of nicotine in a liquid comprising a cartridge assembly as shown in FIG. 1 to FIG. 4.

Mouthpiece (42) extends in two opposite flaps (98) that will fit smoothly with a housing (66) of the electronic nicotine delivery system (4) (see FIG. 7). Flaps 98 provide a comparatively rigid connection between the cartridge assembly (2) and the housing (66) when the cartridge assembly (2) is fully inserted in the housing (66). The flaps (98) include a plurality of tabs (102 (see FIG. 8) that lock the cartridge assembly (2) to the housing (66) of the electronic nicotine delivery system (4). Body assembly (6) of cartridge assembly (2) may be provided with a tamper protection device or an anti-counterfeit protection element (48). In various exemplary embodiments, anticounterfeit protection element (48) comprises three electrically conducting pads (58) arranged at predetermined exterior positions on body assembly (6). It is important to note that the plurality of pads (58) are in a particular configuration; namely, a linear arrangement. In alternate embodiments, a different number of pads (58) may be utilized in any suitable configuration that matches the contacts (62) on the inside of the housing 66 (see FIG. 15). For example, the plurality of pads (58) may be arranged in a step-wise configuration or in a cruciform. When the cartridge assembly (2) is inserted into the housing (66), the three pads (58) make contact with electrical contact elements (62), which complete a circuit that measures resistance. Essentially, when the cartridge assembly (2) is moved relative to and within the housing (66) the anticounterfeit protection element (48) is affected by matching pads (58) on the inside wall of housing (66). Any simple circuit for measuring resistance may be utilized, for example, a Wheatstone bridge. If the resistance matches the preset resistance value programmed into the controller of the electronic nicotine delivery device (4), the cartridge assembly (2) is the proper one for the electronic nicotine delivery system (4) and the electronic nicotine delivery system (4) will work. If the resistance does not match, the cartridge assembly (2) is not the proper one for the electronic nicotine delivery system (4) and the electronic nicotine delivery system (4) will not work. It is important to note that the plurality of pads (58), for example three pads (58), may have equal resistance values, or different resistances values. What is measured is the total resistance when the circuit is completed by the insertion of the cartridge assembly (2) into the housing (66). In alternate exemplary embodiments, other electrical characteristics may be measured, for example, capacitance. Once again there are well known simple circuits that may be utilized to measure capacitance as well as any number of other electrical parameters. The plurality of pads (58) may be made from any suitable material and mounted to circuit board (64) by any suitable means. The choice of material is determined by the selected parameter to be measured which may also impact the means of attachment of the plurality of pads (58) to the circuit board (64).

In one exemplary embodiment, the cartridge assembly (2) and electronic nicotine delivery system (4) comprises anti-reuse feature(s) as briefly set forth above. In one exemplary embodiment, a plurality of springs (68) are positioned in such a configuration/position that permits contact with plurality of pads 70 (see FIG. 15) inside housing (66). In this position/configuration, it is possible to determine electrical properties, such as an electrical resistance, between the plurality of springs (68). An electronic circuit (64) within housing (66) contacts the plurality of springs (68) at electrical pads (70) when the cartridge assembly (2) is in position inside the housing (66) and determines preset electrical properties. More specifically, the plurality of springs (68) make contact with elements within the housing (66) in order to complete the circuit when the cartridge assembly (2) is inserted into housing (66). The controller within the electronic nicotine delivery system (4) determines that the circuit is complete by measuring a particular electrical parameter such as resistance; however, other parameters may be utilized. Upon removal of the cartridge assembly (2) from the housing (66), one or both of the springs (68) are bent out of the way by a member (104) of the housing (66) such that if re-inserted, the springs (68) will no longer make contact with corresponding elements or pads (70) in the housing (66) and the circuit will not be complete. The member (104) that bends the one or both springs (68) may be a simple wedge-like protrusion that only bends the springs (68) upon removal of the cartridge assembly (2). In alternative exemplary embodiments, one or both springs (68) may be broken off rather than simply bent; however, a piece of the spring (68) may fall into the housing (66) and become stuck therein. In a preferred embodiment, the springs (68) may comprise any suitable conductive material that is pliable or bendable. In the embodiment where the springs (68) are designed to break rather than to bend, the springs (68) may be formed from a conductive but friable material. In addition, in alternative exemplary embodiments, the springs (68) may be replaced with any suitable conductive material that forms a complete circuit when properly aligned, for example, a conductive foil that tears away when the cartridge assembly is removed from the housing (66).

The housing (66) may be arranged with an internal edge that will separate the springs (68) when the cartridge is removed from the housing (66). If the same cartridge assembly (2) is inserted again, the pads (70) mounted on circuit board 64 will not contact the springs (68) correctly and the electrical properties as determined by the electronic circuit will not correspond to the stored data. As a result, the electronic nicotine delivery system (4) will not be enabled for proper use.

Sealing element/cap (14) is located at first/bottom end of the cartridge assembly (2). It allows air and vapor, such as nicotine vapor to pass through the air-let openings (50) of the sealing element/cap (14) into the air-let channels (26) of the body assembly (6). In various exemplary embodiments, an air permeable membrane (32) is provided over an opening (12) of the reservoir (8) at the second/top end of the cartridge assembly (2). The air permeable membrane (32) will allow air to enter the reservoir (8) when liquid is removed from the reservoir (8) through the wick (24). In one exemplary embodiment, the semipermeable membrane (32) is made from polytetrafluoroethylene or PTFE. In one exemplary embodiment, the semipermeable membrane (32) allows for air replenishment in the cartridge assembly (2) between puffs. In various exemplary embodiments, air can enter the reservoir (2) through various openings, for example, side openings (50) that extend to the air-let channels (26) or preferably inlet ports (106) described in greater detail subsequently. In various embodiments, reservoir (8) is closed at mouthpiece (42) by an upper wall section (10). In this embodiment no air permeable membrane (32) is used.

Figure 5:
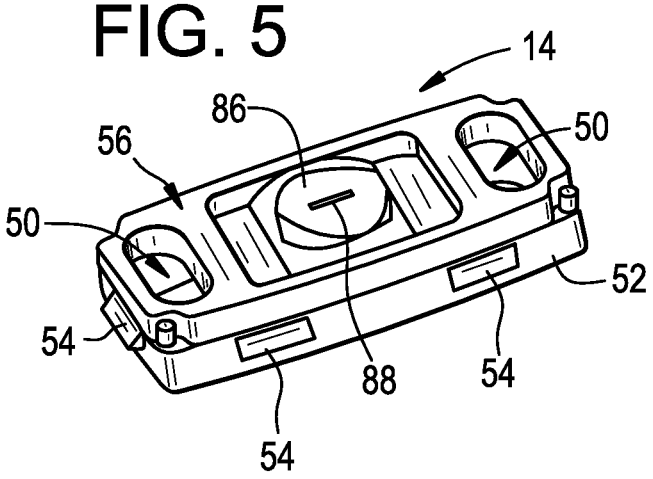
FIG. 5 is a schematic perspective view of the first exemplary embodiment of a sealing element/cap of the cartridge assembly of FIG. 1.
Figure 6:
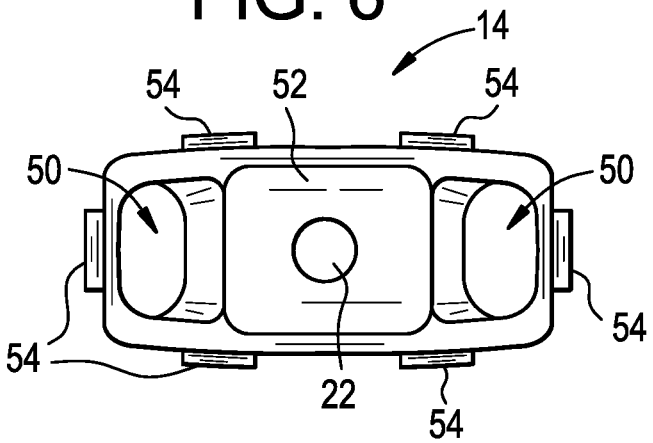
FIG. 6 is a bottom view of the sealing element/cap of FIG. 5.

In the exemplary embodiment of the sealing element/cap (14) shown in FIG. 5 and FIG. 6, the sealing element (14) comprises a gasket (52), which includes two side openings (50), a valve (56), which includes a protruding portion (86), and a plurality of interference fit tabs (54). A central opening (88) such as a slit is formed in protruding portion (86) of the valve (56). The central opening/slit (88) is normally closed but will open when wick (24) is inserted into the cartridge assembly (2) through the valve (56). Gasket (52) will seal the bottom end of cartridge assembly (2). When the cartridge assembly (2) is inserted in the housing (66) of the electronic nicotine delivery system (4), the gasket (52) will seal the air-let openings (50) to prevent leakage of nicotine vapor from a vaporizing chamber (82), see FIGS. 14 and 15, of the electronic nicotine delivery system (4).

The cartridge assembly (2) and the different components thereof should be made from a material that is resistant against nicotine or salts thereof. Examples of materials include any kind of polymeric materials such as polyester, polyacrylonitrile (PAN) resin (Anobex™), cyclic olefin copolymer or High-Density polyethylene (HDPE). The cartridge assembly (2) as defined above may be sealed at the end of the sealing element/cap (14) and the body assembly (6) or the sealing element/cap (14) and the mouth piece (42) to prevent environmental particles from entering into the cartridge assembly (2) during storage and transportation.

Formulations

In the reservoir (8) and the fibrous material (20) there is a solution/liquid such as a nicotine solution comprising nicotine or a salt thereof. The liquid formulation includes at least 12 percent by weight of water, at least 70 percent by weight of propylene glycol; and at least 2 percent by weight of nicotine or a salt thereof. In one embodiment, the liquid formulation contains at least 15 percent by weight of water, such as at least 20 percent by weight of water. In another embodiment, the liquid formulation contains up to 28 percent by weight of water, such as up to 25 percent by weight of water, such as up to 20 percent by weight water.

In another embodiment, the liquid formulation contains at least 75 percent by weight of propylene glycol, such as at least 80 percent by weight of propylene glycol. In another embodiment, the liquid formulation contains up to 86 percent by weight of propylene glycol, such as up to 80 percent by weight of propylene glycol, such as up to 75 percent by weight propylene glycol. In another embodiment, the liquid formulation includes from 15 to 25 percent by weight of water, from 70 to 80 percent by weight of propylene glycol; and from 2 to 10 percent by weight of nicotine or a salt thereof.

Further, the liquid formulation includes no more than 5 percent by weight by weight of glycerol, such as no more than 1 percent by weight of glycerol, such as including no glycerol or being substantially free from glycerol. As discussed above, the presence of glycerol in the formulation will result in a more visible aerosol form of the liquid formulation. Further, glycerol has a higher boiling point than propylene glycol, which would thus potentially raise the boiling point of the liquid formulation. Still further, glycerol can crystalize at low temperatures.

Still further, the liquid formulation includes no more than 5 percent by weight of ethanol, such as no more than 1 percent by weight of ethanol, such as including no ethanol or being substantially free from ethanol. The inclusion of ethanol is not desired because of both the risk of separation due to rapid evaporation when heating the formulation to create an aerosol as well as the desire of certain users to avoid the intake of ethanol into their body. As discussed above, the liquid formulation includes at least 12 percent by weight of water (e.g., from 12 to 28 percent water).

The liquid formulation contains at least 2 percent by weight of nicotine or a salt thereof. In one embodiment, the liquid formulation includes nicotine (i.e., the free base of nicotine). In another embodiment, the liquid formulation includes a salt of nicotine. Examples of nicotine salts include, but are not limited to, formic (2:1), acetic (3:1), propionic (3:1), butyric (3:1), 2-methylbutyric (3:1), 3-methylbutynic (3:1), valeric (3:1), lauric (3:1), palmitic (3:1), tartaric (1:1) and (2:1), citric (2:1), malic (2:1), oxalic (2:1), benzoic (1:1), gentisic (1:1), gallic (1:1), phenylacetic (3:1), salicylic (1:1), phthalic (1:1), picric (2:1), sulfosalicylic (1:1), tannic (1:5), pectic (1:3), alginic (1:2), hydrochloric (2:1), chloroplatinic (1:1), silcotungstic (1:1), pyruvic (2:1), glutamic (1:1), and aspartic (1:1) salts of nicotine. While the use of the free base of nicotine is generally preferred, the use of such salts may be desirable to lower the pH to potentially reduce irritation for liquid formulations containing a high concentration of nicotine.

As discussed above, the liquid formulation contains at least 2 percent by weight of nicotine or a salt thereof, such as from 2 to 10 percent, such as from 3 to 8 percent, such as from 3 to 6 percent by weight of nicotine or a salt thereof. In one embodiment, the liquid formulation contains at least 3 percent by weight (e.g., 3-8 percent by weight), such as at least 4 percent by weight (e.g., 4-8 percent by weight), such as at least 5 percent by weight (e.g., 5-8 percent by weight) of nicotine or a salt thereof. Benefits of such a high concentration of nicotine include reducing the amount of vapor needed to deliver a specified amount of nicotine and reducing the number of inhalations needed to release the dose.

While the foregoing description and drawings represent exemplary embodiments of the present disclosure, it will be understood that various additions, modifications and substitutions may be made therein without departing from the spirit and scope and range of equivalents of the accompanying claims. In particular, it will be clear to those skilled in the art that the present invention may be embodied in other forms, structures, arrangements, proportions, sizes, and with other elements, materials, and components, without departing from the spirit or essential characteristics thereof. In addition, numerous variations in the methods/processes described herein may be made within the scope of the present disclosure.

Operation

Referring back to FIGS. 1-15, the electronic nicotine delivery system (4) includes a power source (78) and an electric heater or heating element (80) contained within a housing (66). The housing (66) has at least one air inlet (106), see FIGS. 12 and 14, and provides a receptacle (108), see FIG. 15, for cartridge assembly (2), described in detail above, proximate the electric heater (80). When assembled, the housing (66), electric heater (80), and cartridge assembly (2) cooperate to form a vaporization chamber (82) (see FIG. 14). The assembled electronic nicotine delivery system (4) also provides a predetermined airflow from the at least one air inlet (106) through the vaporization chamber (82), an outlet conduit (26) and to the outlet (44) of the mouthpiece (42) to permit a user to inhale the nicotine aerosol formed therein. In addition, the assembled electronic nicotine delivery system (4) provides a liquid conduit from the reservoir (8) to the electric heater (80), preferably an elongate wick (24) as described above. The housing (66) may also provide for connectivity to an outside electrical source and/or data communication, such as a USB port (110), see FIG. 14, to supply and/or resupply the internal power source (78), preferably a rechargeable battery.

The internal power source (78) is sufficient to power the electric heater (80), a programmable controller (not shown), and any desired feedback to a user (e.g., light), external computer, or network. The programmable controller receives information from a pressure sensor (detecting inhalation by a user), and, possibly, other sensors (such as temperature sensors) to control the power delivered to the electric heater (80), and controls over temperature sensor(s), which can terminate power to the electric heater (80) to prevent undesirable and/or dangerous thermal events. The programmable controller may provide for data collection, storage and communication to the external computer. This may be communicated through a wired or wireless connection. The internal power source (78) can be any appropriate portable power source (78) such as a primary or secondary battery or fuel cell.

The electric heater (80) is mounted on a base plate (112) to isolate electrical resistance heater elements from other, thermally sensitive components of the electronic nicotine delivery system (4). The base plate (112) may be formed from any suitable material with sufficient strength to support all elements attached thereto while providing an insulative function, i.e. low thermal conductivity. The electric heater (80) comprises at least one electrical resistance heater element contained in a heat diffusing material. The diffusion of the heat through the heat diffusing material generally evens out heat profile generated by the heating element(s) to prevent the formation of localized hot spots on the electric heater (80) surface.

As indicated above, the cartridge assembly (2) preferably includes a reservoir (8) containing a nicotine solution and a mouthpiece (42) for drawing a nicotine aerosol from the electronic nicotine delivery system (4). In addition, the assembled electronic nicotine delivery system (4) provides a liquid conduit from the reservoir (8) to the electric heater (80). In a preferred embodiment, the liquid conduit is an elongate wick (24) extending from the reservoir (8) to the electric heater (80). The elongate wick (24) intimately contacts the electric heater (80) surface to enable the thermal energy to vaporize the nicotine solution transported thereto by the elongate wick (24). As the nicotine solution is vaporized, the elongate wick (24) transports additional nicotine solution to the electric heater (80) through capillarity.

The assembled electronic nicotine delivery system (4) also provides a vaporization chamber (82) proximate the electric heater (80). It is in the vaporization chamber (82) that the electric heater (80) vaporizes the nicotine solution transported by the elongate wick (24) and in which the vaporized nicotine solution combines with outside air drawn in through one or more inlet ports (106) to form a nicotine aerosol. The vaporization chamber (82) also communicates with the outlet (44) of the mouthpiece (42) via at least one outlet conduit (40) in the cartridge assembly (2) to permit a user to draw the nicotine aerosol into his or her mouth.

Figure 14:
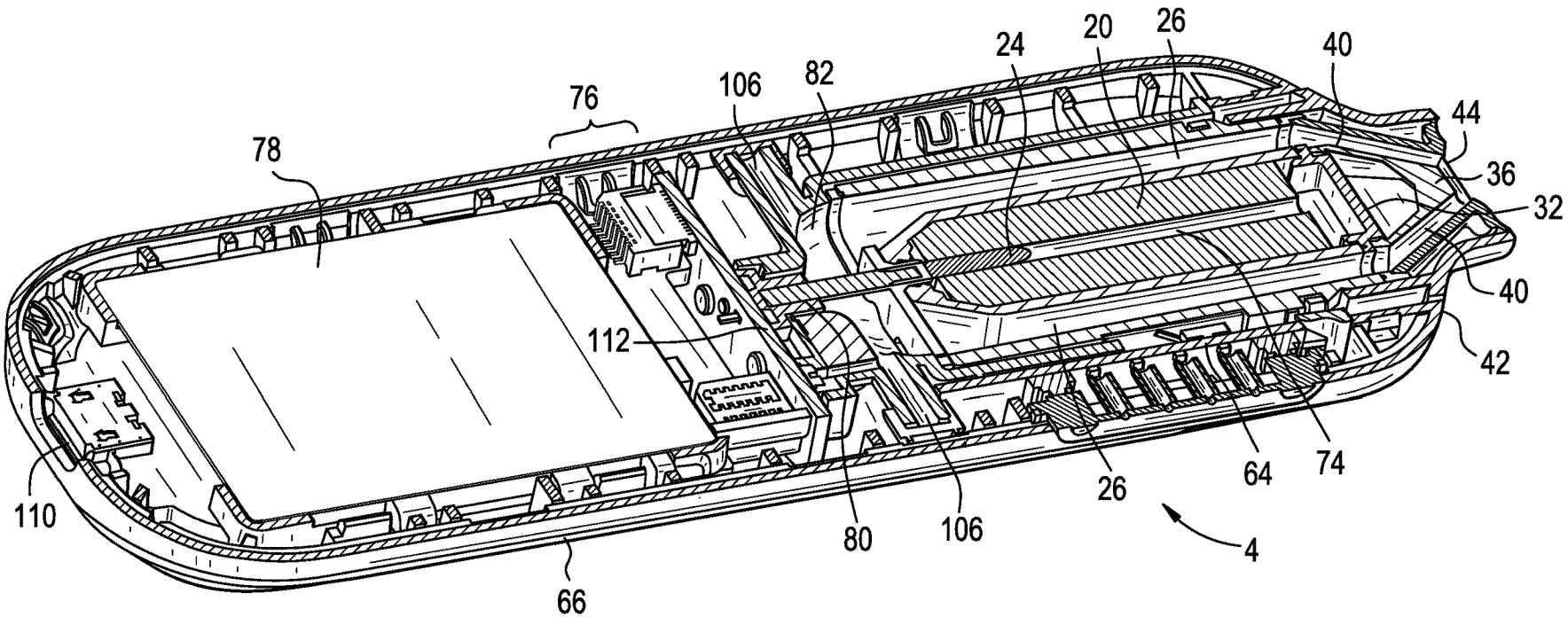
FIG. 14 is a cutaway perspective view of the electronic nicotine delivery system of the present invention of FIG. 12.

FIG. 14 illustrates one example of an air flow through the electronic nicotine delivery system (4). This a schematic figure to explain the process and is not intended to be limiting of the actual location of all elements disclosed therein. As shown in FIG. 14, when a user draws air through outlet (44) from the mouthpiece (42), negative pressure causes air to flow into the assembled electronic nicotine delivery system (4) through one or more air-let ports (106). In particular, air is withdrawn from the vaporization chamber (82) through the outlet conduits (26) and (40), lowering the air pressure in the chamber (82). The withdrawn air is replaced via air inlet ports (106) in the housing (66), proximate the vaporization chamber (82), and also through semi-permeable membrane (32). The lowered air pressure in the chamber (82) is sensed by a pressure sensor disposed proximate the base plate (112), outside of the vaporization chamber (82). The lower air pressure proximate the pressure sensor activates an operatively coupled switch with pressure sensor. This pressure sensor, in turn, activates the electric heater (80), which in turn heats the nicotine solution in contact therewith on the surface of the wick (24). The nicotine solution is vaporized and combined with air in the vaporization chamber (82), forming a nicotine aerosol. The nicotine aerosol is evacuated from the vaporization chamber (82) through the outlet conduits (26) and (40) and delivered to the mouthpiece (42) and, ultimately, the user's mouth. As the nicotine solution is vaporized, additional solution is drawn from the reservoir (8) along wick (24) to electronic heater (80). The volume of nicotine solution removed from reservoir (8) is replaced by air drawn through the outlet (44) and the semi-permeable membrane (32). In one exemplary embodiment, after a predetermined time (e.g., determined by the programmable controller), the power to the electric heater (80) is terminated, the vaporization chamber (82) cools, and no further nicotine aerosol is formed. The user will then stop drawing on the electronic nicotine delivery system (4), ending his/her "treatment". Alternatively, the user may stop drawing on the electronic nicotine delivery system (4) prior to the predetermined time. In such a case, the pressure in the vaporization chamber (82) will return to atmospheric pressure and the pressure sensor will signal switch to terminate power to the electric heater (80).

The electronic nicotine delivery system (4) may be used with accessories such as a charging case, which may include additional power supply and electronics.

One skilled in the art will further appreciate that the embodiments may be used with many modifications of structure, arrangement, proportions, sizes, materials, and components and otherwise, used in the practice of the disclosure, which are particularly adapted to specific environments and operative requirements without departing from the principles described herein. The presently disclosed embodiments are therefore to be considered in all respects as illustrative and not restrictive. The appended claims should be construed broadly, to include other variants and embodiments of the disclosure, which may be made by those skilled in the art without departing from the scope and range of equivalents.

The invention claimed is:

1. A cartridge assembly for use in an electronic nicotine delivery system comprising:

a) a body assembly having an interior surface defining an interior volume, the interior volume including a reservoir, the reservoir having a top wall with an opening formed therein, a sealing element comprising at least one side opening, a gasket, and one or more interference fit tabs for securing the sealing element to the cartridge assembly, and side walls having an inner surface and an outer surface, the interior surface of the side walls defining an interior volume of the reservoir;

b) a port formed in the sealing element of the reservoir to allow insertion of a wick therethrough from the electronic nicotine delivery system;

c) at least one conduit formed between the outer surface of the side walls of the reservoir and the interior surface of the body assembly, the at least one conduit having at least one open top end, at least one open bottom end, and being configured for conducting aerosolized nicotine; and d) a manifold for holding and distributing aerosolized nicotine, the manifold positioned above the top wall of the reservoir, the manifold having an open top end and at least one open bottom end, and at least one interior channel connecting the open top end with the at least one open bottom end, wherein the at least one open bottom end is secured onto the at least one open top end of the at least one conduit and is in fluid communication with the at least one conduit.

2. The cartridge assembly according to claim 1, wherein the interior volume of the reservoir contains a nicotine solution.

3. The cartridge assembly according to claim 1, further comprising a semipermeable membrane positioned on the opening in the top wall of the reservoir and configured to allow equalization of pressure between the reservoir and external environment during use.

4. The cartridge assembly according to claim 1, wherein the interior volume secures a nicotine saturated fibrous material, and further comprising:

a) a semipermeable membrane positioned on the opening in the top wall of the reservoir and configured to allow equalization of pressure between the reservoir and external environment during use;

b) a mouthpiece positioned above the manifold, the mouthpiece having an outlet in fluid communication with the at least one interior channel of the manifold, the mouthpiece configured for delivering aerosolized nicotine into the mouth of a user; and c) an anti-reuse element mounted to the outer surface of the body assembly, the anti-reuse element configured to preclude reuse of the cartridge assembly once removed from the electronic nicotine delivery system.

5. The cartridge assembly according to claim 1, wherein the at least one side opening is in register with the open bottom end of the at least one conduit.

6. The cartridge assembly (2) according to claim 1, wherein the port comprises a valve to provide a seal around the wick.

7. The cartridge assembly according to claim 1 further comprising a mouthpiece positioned above the manifold, the mouthpiece having an outlet in fluid communication with the at least one interior channel of the manifold, the mouthpiece configured for delivering aerosolized nicotine into the mouth of a user.

8. The cartridge assembly according to claim 1, wherein the interior volume of the reservoir secures a nicotine saturated fibrous material.

9. The cartridge assembly according to claim 8, wherein the nicotine saturated fibrous material includes a slit for receiving the wick.

10. The cartridge assembly according to claim 8, wherein the nicotine saturated fibrous material includes a channel for receiving the wick.

11. The cartridge assembly according to claim 1 further comprising an anti-counterfeit element, the anti-counterfeit element configured to preclude use of an unauthorized cartridge in the electronic nicotine delivery system.

12. The cartridge assembly according to claim 11, wherein the anti-counterfeit element comprises a plurality of pads mounted on a substrate attached to the body assembly of the cartridge assembly, the plurality of pads making electrical contact with corresponding electrical contact elements on an electronic circuit board within a housing of the electronic nicotine delivery system, the plurality of pads being arranged in a predetermined pattern having predetermined electrical characteristics.

13. An electronic nicotine delivery system according to claim 12 further comprising an electrical module, a power supply, a heating element, and a vaporization chamber.

14. The cartridge assembly according to claim 1, further comprising an anti-reuse element mounted to the outer surface of the body assembly, the anti-reuse element configured to preclude reuse of the cartridge assembly once removed from the electronic nicotine delivery system.

15. The cartridge assembly according to claim 14, wherein the anti-reuse element comprises one or more spring elements configured to make electrical contact with corresponding electrical contact elements mounted to a PCB within the housing of the electronic nicotine delivery system, the one or more spring elements being configured to be disrupted upon removal of the cartridge assembly from the housing.

16. The cartridge assembly according to claim 15, wherein the one or more spring elements are made from a frangible material.

17. The cartridge assembly according to claim 15, wherein the one or more spring elements are made from a pliable material.

18. An electronic nicotine delivery system according to claim 15 further comprising an electrical module, a power supply, a heating element and a vaporization chamber.

* * * * *